United States Patent [19]

Hartta

[11] 4,164,060

[45] Aug. 14, 1979

[54] APPARATUS FOR ASSEMBLING A SHADOW MASK AND PANEL OF A PICTURE TUBE OF A TELEVISION RECEIVER

[75] Inventor: Matti O. Hartta, Soormarkku, Finland

[73] Assignee: Oy. W. Rosenlew AB., Pori, Finland

[21] Appl. No.: 922,391

[22] Filed: Jul. 6, 1978

[30] Foreign Application Priority Data

Jul. 6, 1977 [FI] Finland ..... 772124

[51] Int. Cl.[2] ..... H01J 9/18

[52] U.S. Cl. ..... 29/25.19; 29/25.15

[58] Field of Search ..... 29/25.19, 25.2, 25.15; 269/321 T

[56] References Cited

U.S. PATENT DOCUMENTS

| | | | |
|---|---|---|---|
| 3,284,884 | 11/1966 | Prazak | 29/25.19 |
| 3,482,286 | 12/1969 | Fassett et al. | 29/468 X |
| 3,899,812 | 8/1975 | Baranski et al. | 29/25.19 |
| 4,019,231 | 4/1977 | Dougherty | 29/25.15 |
| 4,130,919 | 12/1978 | Oyama | 29/25.19 |

*Primary Examiner*—Richard B. Lazarus

*Attorney, Agent, or Firm*—Ladas, Parry, Von Gehr, Goldsmith & Deschamps

[57] ABSTRACT

An apparatus for assembling a shadow mask and panel of a picture tube of a television receiver, said mask and panel being provided with fixing members engaging each other in a fixed relative position of the mask and panel. The apparatus is provided with separate supports for the mask and panel, one of said supports being made as a floating plate movable relative to the other fixed support parallel to its plane and also perpendicularly to said plane and, in addition, rotatable around an axis perpendicular to said plane. The floating plate is connected to mechanical means for moving the plate relative to the fixed support. In this way, the mask and panel may be positioned only roughly in register on the apparatus, whereby mechanical moving of the floating plate brings the mask and panel in such a relative position that their fixing members automatically engage each other.

8 Claims, 7 Drawing Figures

APPARATUS FOR ASSEMBLING A SHADOW MASK AND PANEL OF A PICTURE TUBE OF A TELEVISION RECEIVER

The present invention relates to an apparatus for assembling a shadow mask and panel of a picture tube of a television receiver, said mask and panel being provided with fixing members engaging each other in a fixed relative position of said mask and panel, said apparatus comprising separate supports for said mask and panel, said supports being adjustable in relation to each other.

In connection with the manufacture of colour television picture tubes, the mask and panel already arranged in pairs must be disassembled and again assembled several times during the various manufacturing steps.

Earlier, this assembling step has been carried out manually.

In the automatization of the assembling step, dimensional variations of the mask and panel have presented a problem. Especially the position of the fixing members interconnecting the parts varies with the result that into a specific panel will fit only a mask originally arranged therein.

The construction of a device for assembling the mask and the panel is also limited by the fact that only relatively small external forces may be applied to the mask.

It is the object of the present invention to provide an apparatus following an automatization of the assembly of both associated parts. This object is achieved by means of an apparatus according to the invention, said apparatus being characterized in that one of said supports is made as a floating plate movable relative to the other support parallel to its plane and in the direction of an axis transverse to said plane and rotatable around said axis, and that said apparatus is provided with operating means connected to said floating plate to bring said plate mechanically in said motion.

The apparatus according to the invention does not even try to guide the parts immediately exactly in register with each other, but the parts are first placed roughly in register, whereafter the correct position is scanned by moving the parts in relation to each other.

Figure 1:
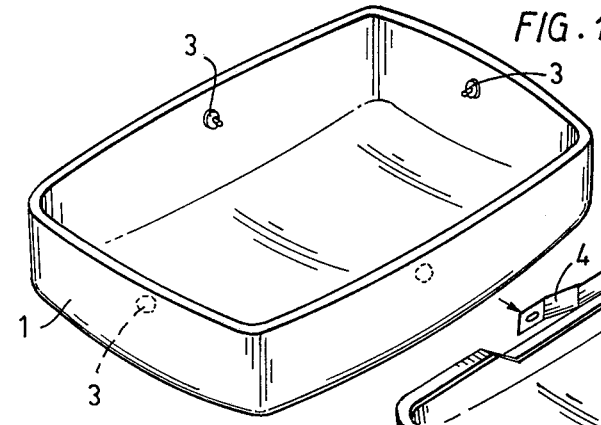
Figure 2:
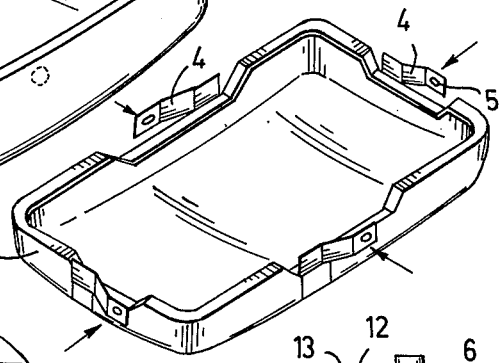
Figure 7:
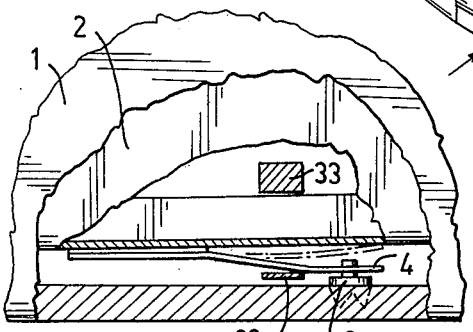
Figure 6:
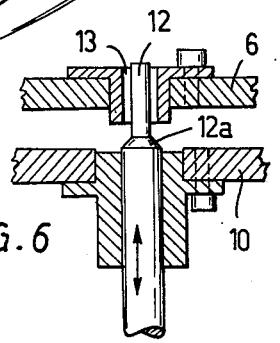
Figure 5:
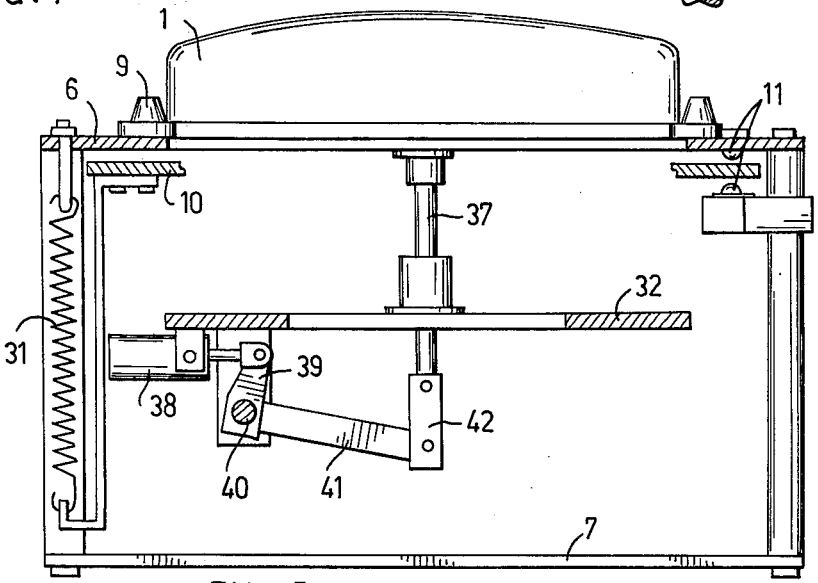
Figure 3:
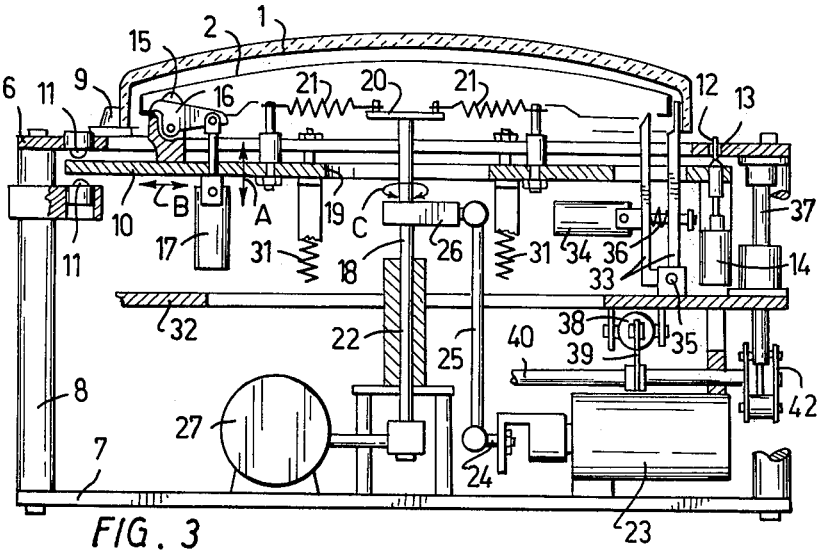
Figure 4:
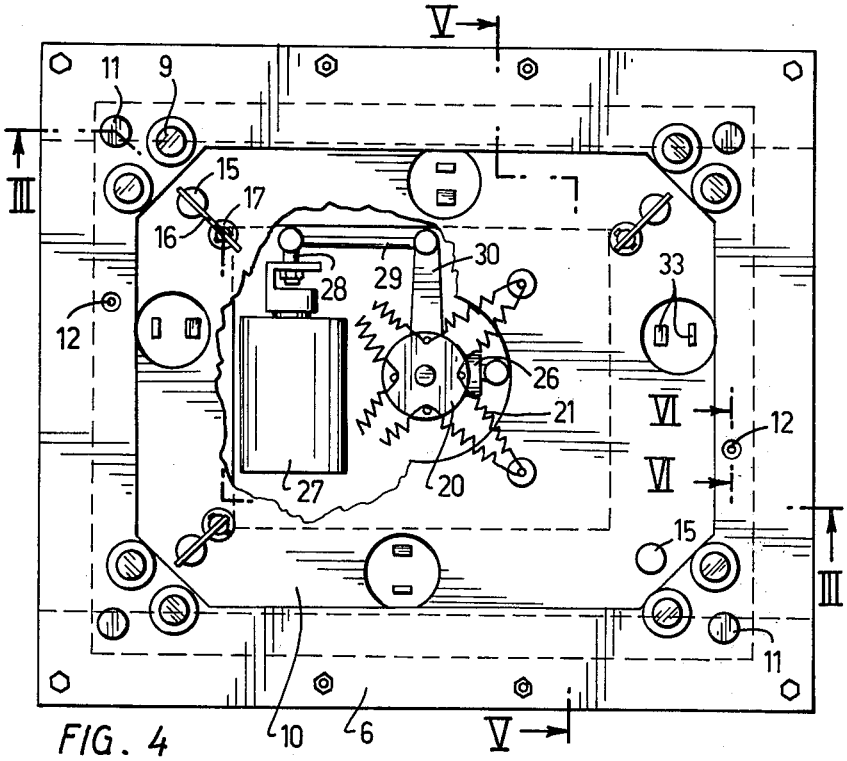

The invention will be described in more detail in the following with reference to the accompanying drawings, wherein FIGS. 1 and 2 are perspective views of a television panel and mask, respectively, to be assembled together, FIG. 3 is a side view in vertical section along line III—III in FIG. 4 of one preferred embodiment of the apparatus according to the invention, FIG. 4 is a top view, partly in section, of the apparatus, FIG. 5 is a vertical section along line V–V in FIG. 4 of the apparatus as seen from the other side, FIG. 6 is an enlarged sectional view along line VI—VI in FIG. 4 of one detail of the apparatus, and FIG. 7 is an enlarged top view, partly in section, of the connection between the mask and panel and of the gripper means of the apparatus.

In FIG. 1, there is shown a panel 1 for a picture tube in a television receiver, and FIG. 2 shows a mask, said mask and panel being connected together by means of conical pins 3 in the inner surface of the panel and by means of leaf springs 4 in the mask frame. The assembling is carried out by pressing the springs inwardly (in the direction of the arrows) and by placing the mask into the panel into its proper location and by releasing the springs, whereby the bias outwardly against the conical pins. The conical pins hit holes 5 in the springs, thereby interlocking the mask and panel without any clearance.

The apparatus according to the invention comprises a frame consisting of an upper horizontal collar plate 6 and a lower bottom plate 7 connected to each other with four rods 8. Guides 9 are attached to four corners in the collar plate for centering the panel 1 into a desired position on the collar plate. The collar plate thus forms a fixed support for the panel.

The apparatus further includes a movable support consisting of a horizontal plate 10 mounted "floatably" between ball rolls 11 attached to the collar plate and said rods and arranged at each corner of the collar plate. The plate is thus able to move vertically within the limits defined by the ball rolls, as shown by arrow A in FIG. 3. The movements of the plate in the horizontal plane shown by arrow B are limited by pins 12 journalled vertically slidably in the plate and extending into corresponding holes 13 in the collar plate, as shown in more detail in FIG. 6. The extent of the horizontal movement is determined by the difference between the pin diameter and the hole diameter. The conical portion 12*a* of the pin 12 also serves as a centering means. The pin is movable vertically by means of a pneumatic cylinder 14 supported by the plate 10. The plate is thus able to rotate to a limited extent also in its own plane, as shown by arrow C.

Guides 15 for the mask 2 are attached to the upper surface of the plate in the corners thereof. Of said guides, three are provided with locking arms 16 displaced by means of pneumatic cylinders 17 supported by the plate 10.

Centrally in the apparatus, there is mounted a vertical rocking shaft 18 extending through a central hole 19 in the plate, said plate being attached to a flange in the upper end of said shaft by means of tension springs 21. The rocking shaft is mounted rotatably and vertically slidably in a bearing bracket 22 supported by the bottom plate 7 of the frame. A gear motor 23 supported by the bottom plate is via a crank 24 and an arm 25 and a bracket 26 connected to the drive shaft 18. Another gear motor 27 supported by the bottom plate is in turn connected via a crank 28 and an arm 29 to an arm 30 attached to the lower end of the rocking shaft. The arrangement is such that the rotary motion of the gear motor 23 causes a vertical reciprocating movement of the rocking shaft in the bearing bracket, while the rotary motion of the gear motor 27 produces a reciprocating rotation of the rocking shaft in the bearing bracket around its axis.

The movable plate 10 is vertically supported by springs 31.

Between the movable plate 10 and the bottom plate 7 there is mounted an intermediate plate 32 (FIG. 5) to the upper surface of which four grippers 33 are fastened, said grippers being moved by pneumatic cylinders 34. The gripper halfs are pivoted in relation to each other and to the intermediate plate by means of a pivot 35, and a spring 36 between the gripper halfs pushes the halfs apart. The intermediate plate is mounted vertically movably on guides 37. A pneumatic cylinder 38 is mounted on the intermediate plate and connected via an arm 39 to a shaft 40 both ends of which are connected via arms 41 and 42 to the guides 37.

The apparatus operates as follows:

In the initial position of the apparatus, the centering pins 12 are pushed upwardly, i.e. the floating plate 10 is centered and supported by the lowermost ball rolls 11. The locking arms 16 in the guides 15 of the floating plate are located in the open position. The intermediate plate 32 and the grippers 33 are located in the upper position and are opened. The mask 2 is positioned on the guides 15. The locking arms in the three guides are closed. The grippers close and press the leaf springs 4 in the mask towards the sides of the mask (FIG. 7). Next, the panel 1 is positioned on the guides 9 of the collar plate 6. Then, the centering is released, i.e. the pins 12 are displaced to their lower position. Thereafter the grippers 33 are released as the piston rod of the cylinder 34 is freely pushed out. Each gripper is opened by means of the return spring 36 and, of course, the spring 4 of the mask. The grippers 33 are retracted along with the intermediate plate to their lower position by means of the cylinder 38.

Now the springs 4 of the mask are resting tensioned against the conical pins 3 of the panel 1. If the position of the mask and panel is correct, the interlocking will take place immediately. However, this happens very seldom wherefore a scanning motion is always carried out. The rocking shaft 18 reciprocates up and down by means of the gear motor 23, the crank 24, the arm 25 and the bracket 26 and, at the same time, turns slower (or faster) to and fro by means of the gear motor 27, the crank 28, the arm 29 and the arm 30, moving thereby by means of the springs 21 the floating plate 10 and the mask located thereto. Thus, the apertured leaf spring 4 of the mask moves in an up-and-down direction relative to the assumed location of the conical pin and, at the same time, reciprocates slowly horizontally, i.e. scans a sufficiently big area so that the pivot 3 is forced to hit the hole 5 in spite of dimensional variations of the parts.

Because the scanning motion is transmitted by means of the springs, the driving means 25–30 for the scanning motion may continue to run even after the locking has taken place, and too great forces are not applied to the mask even then.

When the driving means for the scanning motion have stopped, the locking arm 16 of the mask are opened and a robot lifts the mask/panel combination upon a conveyor. The apparatus is returned to its initial position, whereby it is ready for a new working cycle. The apparatus may be controlled either by control means of its own or by the control means of the robot.

The drawings and the appended specification are only intended to illustrate the idea of the invention. In its details, the apparatus according to the invention may vary considerably within the scope of the claims. Thus, the scanning motions of the floating plate described above may, instead of the two driving means shown, by operated by means of a single driving means. Likewise, other means, for example, electric, hydraulic and similar means, may be used instead of the air cylinders described above.

If the positions of the conical pin of the panel and of the leaf spring of the mask varies in the vertical direction to such an extent that the scanning motion cannot be extended sufficiently, it is possible to use an apparatus which automatically corrects the relative position of the mask and panel in the vertical direction. For example, the panel may be displaced in the vertical direction. The impulse for the correction may be taken by sensing the difference in height of the pin and the leaf spring. A satisfactory result is obtained by sensing the difference in height only between the apparatus frame and the pin.

What I claim is:

1. An apparatus for assembling a shadow mask (2) and panel (1) of a picture tube of a television receiver, said mask and panel being provided with fixing members (3,4) engaging each other in a fixed relative position of said mask and panel, said apparatus comprising separate supports (6,10) for said mask and panel, said supports being adjustable in relation to each other, characterized in that one (10) of said supports is made as a floating plate movable relative to the other support (6) parallel (B) to the plane of said plate and in the direction (A) of an axis transverse to said plane and rotatable (C) around said axis, and that operating means (10,23–30) are connected to said floating plate to move said plate mechanically in said plane as well as along and about said axis whereby a mask and panel on said supports are moved relative to each other to cause final engagement of said fixing members.

2. An apparatus as claimed in claim 1, wherein one (6) of said supports is mounted fixedly in a frame (7,8) and the other support (10) is mounted substantially in parallel under said fixed support on bearings (11) supported by said frame.

3. An apparatus as claimed in claim 2, wherein said movable support (10) is resiliently connected to said operating means (18, 23–30).

4. An apparatus as claimed in claim 2 or 3, wherein said operating means (18,23–30) comprise a vertical rocking shaft (18) in engagement (21) with said movable support (10), a first motor-driven connecting rod (24–26) for reciprocating said shaft in the direction (A) of its axis, and a second motor-driven connecting rod (28–30) for rotating (C) said drive shaft to and fro around its axis.

5. An apparatus as claimed in claim 4, wherein said fixed support (6) and said movable support (10) are provided with guides (9,15) for centering the mask and panel respectively with respect to the supports.

6. An apparatus as claimed in claim 1, said mask (2) being provided with flexibly projecting fixing lugs (4), wherein said apparatus is provided with gripper means (33) for pressing said fixing lugs (4) against said mask.

7. An apparatus as claimed in claim 6, wherein said gripper means (33) are mounted on an intermediate plate (32) provided with means (37–42) for lifting said plate toward said movable support (10) in order to push said gripper means into a pressing position and in order to lower said plate to a non-pressing position of said gripper means.

8. An apparatus as claimed in claim 5, wherein said movable support (10) is provided with centering pins (12) and operating means (14) for pushing said centering pins into holes in said fixed support (6) for centering said supports in relation to each other.

* * * * *